US011638927B2

(12) United States Patent
Lipnizkiy et al.

(10) Patent No.: US 11,638,927 B2
(45) Date of Patent: May 2, 2023

(54) SELECTIVE WETTING OF A ROLLER

(71) Applicant: HP Indigo B.V., Amstelveen (NL)

(72) Inventors: Alex Lipnizkiy, Ness Ziona (IL); Mordechai Arenson, Ness Ziona (IL); Marko Richter, Ness Ziona (IL); Yossi Yaacobov, Ness Ziona (IL); Gil Fisher, Ness Ziona (IL); Michael Vinokur, Ness Ziona (IL); Nadav Shalem, Ness Ziona (IL); Chen Talmor, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 45 days.

(21) Appl. No.: 16/605,205

(22) PCT Filed: Sep. 15, 2017

(86) PCT No.: PCT/EP2017/073361
§ 371 (c)(1),
(2) Date: Oct. 14, 2019

(87) PCT Pub. No.: WO2019/052663
PCT Pub. Date: Mar. 21, 2019

(65) Prior Publication Data

US 2020/0222935 A1 Jul. 16, 2020

(51) Int. Cl.
*B05C 1/08* (2006.01)
*B41F 31/04* (2006.01)
(Continued)

(52) U.S. Cl.
CPC ..... *B05C 1/0813* (2013.01); *B05D 1/002* (2013.01); *B05D 1/26* (2013.01); *B05D 3/042* (2013.01);
(Continued)

(58) Field of Classification Search
CPC ... B05C 1/0813; B05C 1/0817; B05C 1/0826; B05C 1/002; B05C 1/26; B05C 3/042;
(Continued)

(56) References Cited

U.S. PATENT DOCUMENTS 4,332,196 A * 6/1982 Braun ..... B41F 31/00 101/365
5,136,966 A 8/1992 Miyagawa et al.
(Continued)

FOREIGN PATENT DOCUMENTS

EP 0121290 A1 10/1984
EP 0470712 2/1992
(Continued)

OTHER PUBLICATIONS

Krebs, Frederik C."Fabrication and Processing of Polymer Solar Cells: a Review of Printing and Coating Techniques", Apr. 2009, Solar Energy Materials & Solar Cells 93, pp. 394.

*Primary Examiner* — Laura Edwards

(57) ABSTRACT

There is disclosed a selective wetting apparatus comprising a roller rotatable about a roller axis and comprising a wettable roller surface; an applicator unit having a lip which extends parallel to the roller axis and is radially spaced apart from the roller surface by a gap, wherein the applicator unit is to convey liquid agent towards the roller so that the liquid agent forms a liquid bridge over the gap to wet a wetted axial portion of the roller surface; and a flow guide to direct a gas flow into a regulated axial portion of the gap to locally prevent formation of a liquid bridge, and thereby prevent wetting of a corresponding axial portion of the roller surface.

20 Claims, 6 Drawing Sheets

(51) Int. Cl.

| | |
|---|---|
| ***B41F 31/08*** | (2006.01) |
| ***B41F 31/18*** | (2006.01) |
| ***B41F 31/20*** | (2006.01) |
| ***B05D 1/00*** | (2006.01) |
| ***B05D 1/26*** | (2006.01) |
| ***B05D 3/04*** | (2006.01) |

(52) U.S. Cl.
CPC ..... *B41F 31/04* (2013.01); *B41F 31/08* (2013.01); *B41F 31/18* (2013.01); *B41F 31/20* (2013.01)

(58) Field of Classification Search
CPC ..... B41F 31/04; B41F 31/08; B41F 31/18; B41F 31/20; B41F 31/28; B41N 3/08; B41P 2227/70; B41P 2235/40; B05D 1/002; B05D 1/26; B05D 3/042
USPC ..... 118/304, 62, 63, 46
See application file for complete search history.

(56) References Cited

U.S. PATENT DOCUMENTS

| | | | | |
|---|---|---|---|---|
| 5,294,459 | A | 3/1994 | Hogan et al. | |
| 8,535,763 | B2 | 9/2013 | Inoue et al. | |
| 2002/0121239 | A1 | 9/2002 | Tonazzi et al. | |
| 2006/0260542 | A1 | 11/2006 | Neuhaus | |
| 2012/0086155 | A1 * | 4/2012 | Yamauchi ..... | B29C 48/914 264/177.1 |

FOREIGN PATENT DOCUMENTS

| | | | | |
|---|---|---|---|---|
| GB | 191217278 | A | | 7/1913 |
| JP | S57140167 | A | | 8/1982 |
| NL | 2015472 | B1 | | 4/2017 |
| WO | WO2012161779 | | * | 11/2012 |
| WO | WO2015014994 | A2 | | 2/2015 |
| WO | WO2016076848 | A1 | | 5/2016 |
| WO | WO2016116168 | A1 | | 7/2016 |
| WO | WO2017026214 | | * | 2/2017 |

* cited by examiner

SELECTIVE WETTING OF A ROLLER

BACKGROUND

In press printing, a liquid agent such as an ink, a coating or a primer is applied to a wettable surface of a roller, for example an anilox or gravure roller. An auxiliary roller may be provided to selectively wet portions of the roller. For example, the auxiliary roller may have radially-extending rubber portions that engage and wet selected portions of the roller.

BRIEF DESCRIPTION OF DRAWINGS

Examples will now be described, by way of non-limiting example, with reference to the accompanying drawings, in which.

DETAILED DESCRIPTION

Figure 1:
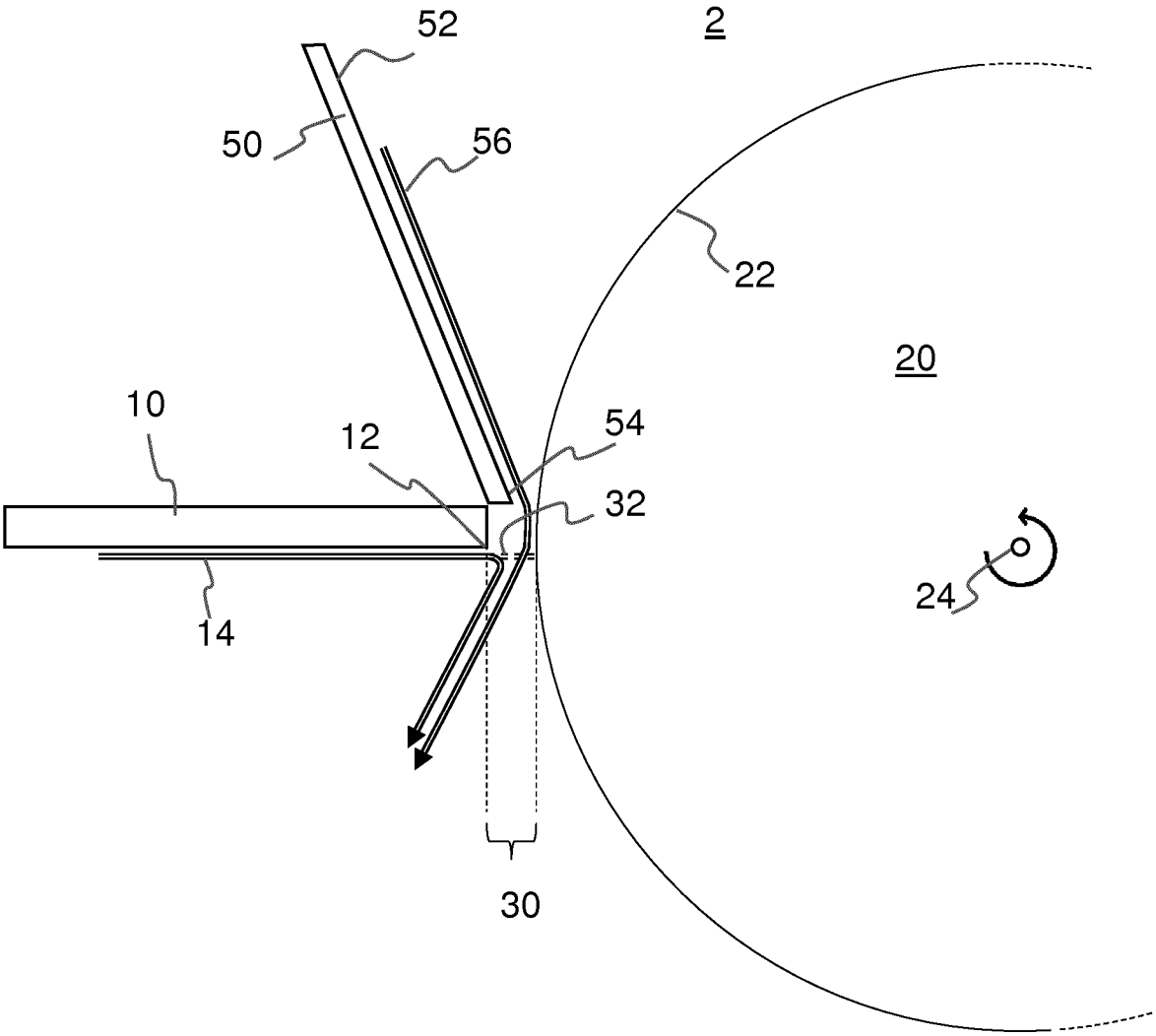
FIG. 1 is a simplified schematic cross-sectional view of an example selective wetting apparatus.

FIG. 1 shows an example selective wetting apparatus 2 for use in press printing, comprising a roller 20, an applicator unit 10 to convey a liquid agent to the wet a wettable roller surface 22 of the roller, and a flow guide 50 to locally prevent wetting along an axial portion of the roller surface 22.

The roller 20 is rotatable about a roller axis 24. In this example it is substantially cylindrical.

The applicator unit 10 is to receive and convey a liquid agent 14 to an applicator lip 12 which extends parallel to the roller axis 24 and is radially spaced apart from the roller surface 22 (i.e. with respect to the roller axis 24) to define a gap 30 between the lip 12 and the roller surface 22. The gap 30 therefore has an axial extent corresponding to the overlapping axial extents of the lip 12 and the roller surface 22.

The gap 30 is sized so that liquid agent 14 conveyed to the lip 12 forms a liquid bridge 32 (shown in dashed lines in FIG. 1) over the gap 30 to wet the wettable roller surface 22. A suitable size for the gap may depend on the operating conditions (e.g. temperature), the type of liquid agent 14, and the materials and surface conditions of the lip 12 and the roller 20.

In this particular example, the roller axis 24 is substantially horizontal, and the applicator unit 10 is disposed to one lateral side of the roller 20 so that the radial gap between the lip 12 and the roller surface is substantially horizontal. In other words, the lip 12 is positioned so that the closest point on the roller surface as a tangent direction which is substantially vertical. In other examples, the applicator unit 10 may be at a different angular position with respect to the roller surface, for example, the lip 12 may be on a radial line that is inclined to the horizontal by ±30°.

The flow guide 50 is to direct a gas flow 56 into a regulated axial portion of the gap 30 to locally prevent formation of a liquid bridge in the regulated axial portion, and thereby prevent wetting of a corresponding axial portion of the roller surface 22. As shown in FIG. 1, the flow guide 50 may comprise an elongate member extending from a flow reception portion 52 away from the gap 30 to a flow guide edge 54 adjacent the gap 30. For example, a gas flow 56 may be received on the flow guide 50 at the flow reception portion 52 and flow along the flow guide 50 to be discharged into the gap 30 at the flow guide edge 54 to locally prevent formation of a liquid bridge.

The axial portion of the gap 30 corresponding to the guide edge 54 is referred to as a regulated axial portion of the gap, since the presence of a liquid bridge 32 over the gap 30 in that axial portion can be regulated by the presence or absence of the gas flow 56 being directed along the flow guide 50 into the gap 30.

In this example, the flow guide 30 is generally disposed above the gap 30 so that the gas flow 56 is directed into the gap 30 along a direction having a downward component. This may aid diverting the liquid agent 14 to prevent formation of a liquid bridge. The gas flow 56 may be directed along a direction which is inclined with respect to the vertical, and may be inclined with respect to the local tangent of the roller surface 22 at the gap 30.

FIG. 1 is a cross-sectional view of the wetting apparatus at the regulated axial portion. FIG. 1 shows the flows of liquid agent 14 and gas 56 in the wetting apparatus 2 according to two modes of use corresponding to the presence and absence of a gas flow 56 along the flow guide 50. In both modes of use, it may be assumed that the roller 20 rotates about the roller axis 24 so that the roller surface 22 moves downwardly at the gap 30 (i.e. anticlockwise in FIG. 1).

In the first mode of use, there is no gas flow along the flow guide 50 so that a liquid bridge 32 forms from the lip 12 to the roller surface 22 (as shown in dashed lines) over the regulated axial portion of the gap 30, and liquid agent 14 is thereby conveyed over the liquid bridge to the roller surface 22. In the second mode of use, the gas flow 56 along the flow guide 50 is present and is directed into the regulated axial portion of the gap 30 to divert a path of liquid agent 14 delivered along the applicator unit 10 so that it is diverted away from the roller surface 22. In FIG. 1, the liquid agent 14 is shown in solid lines, as diverted by a gas flow 56 directed into the regulated axial portion of the gap.

In this example, the flow guide 50 has an open guide surface to direct the gas flow to the gap. The term "open guide surface" relates to the gas flow 56 along the flow guide 50 being unbounded except by the guide surface of the flow guide. In other words, the guide surface of the flow guide 50 is not opposed by an opposing guide surface which bounds the flow. The gas flow may follow the guide surface by virtue of the Coanda effect (i.e. a boundary layer effect that causes it to follow the guide surface) This is in contrast to a ducted flow which is bound by opposing walls enclosing the flow. However, in other examples, a flow guide may be to direct a ducted gas flow.

Figure 2:
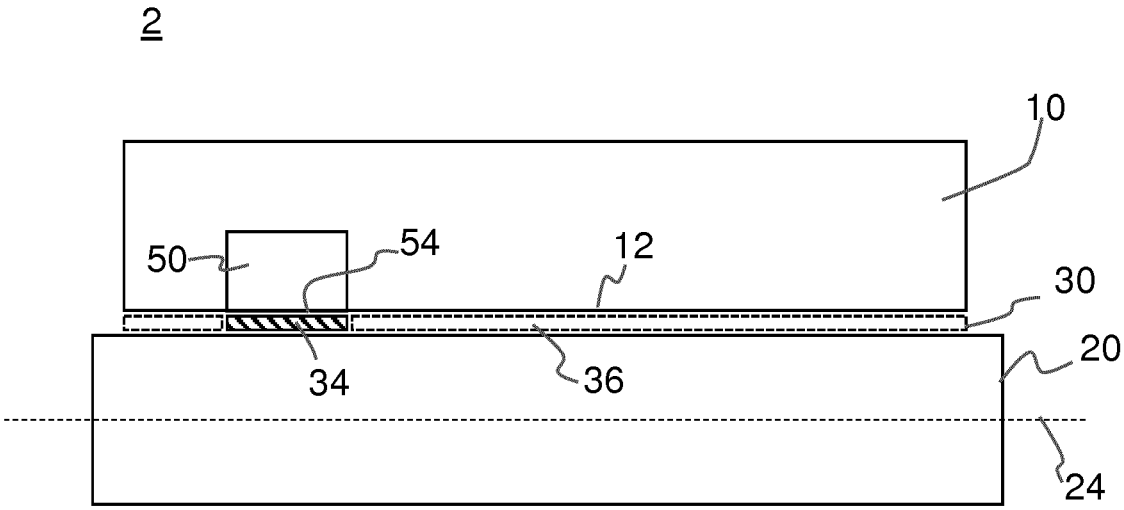
FIG. 2 is simplified schematic plan view of the wetting apparatus of FIG. 1.

FIG. 2 shows the example wetting apparatus 2 in plan view. As shown, in this example the roller 20 has a greater extent along the roller axis 24 than the lip 12 of the applicator unit 10, such that the roller 20 protrudes beyond the lip 12 at both axial ends. Accordingly, in this particular example the gap 30 has an axial extent along the roller axis 24 equal to that of the lip 12.

As shown, in this example the flow guide 50 has an axial extent along the roller axis 24 which is less than the axial extent of the gap 30, and is spaced apart from both axial ends of the gap 30. Accordingly, the flow guide 50 defines a regulated axial portion 34 of the gap corresponding to where the guide edge 54 of the flow guide 50 is to direct the flow into the gap 30 to locally prevent formation of a liquid bridge. In this example, all other axial portions 36 of the gap 30 (i.e. on both sides of the regulated axial portion 34) are to convey the liquid agent across the gap 30 uninterrupted, such that the corresponding axial portions 36 of the roller surface are wetted in use. Such axial portions of the roller surface may therefore be referred to as "wetted axial portions", and the respective axial portions of the gap 30 may be referred to as "unregulated axial portions".

Figure 3:
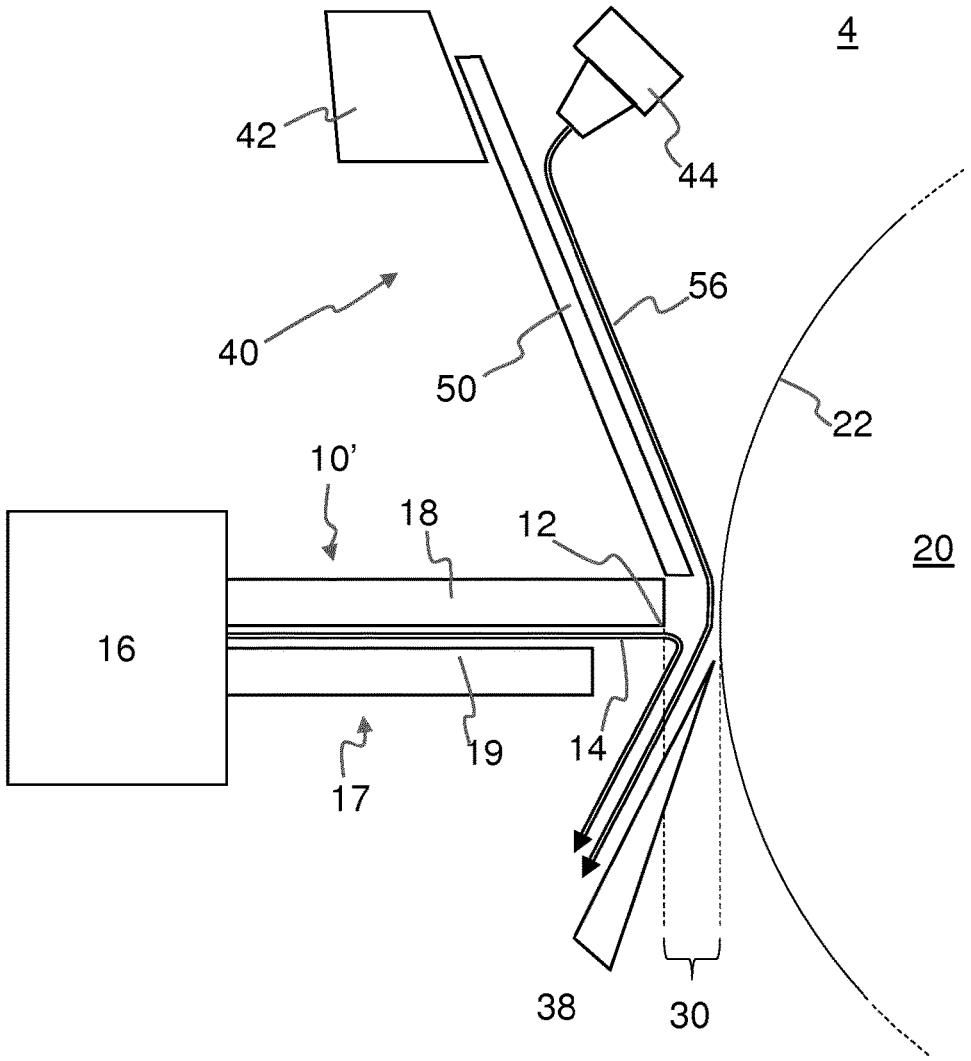
FIG. 3 is a simplified schematic cross-sectional view of an example selective wetting apparatus.

FIG. 3 shows a further example of a selective wetting apparatus 4 which differs from that described above with respect to FIGS. 1 and 2 in the configuration of the applicator unit 10'; a flow unit 40 comprising two flow guides 50; a controllers; and a doctor blade 38. In this example, the selective wetting apparatus 4 is for controlling selective wetting of a liquid agent which is a print agent such as a primer or coating for use in press printing.

In this example, the applicator unit 10' comprises a supply chamber 16 which is to store and supply liquid agent 14 at a regulated pressure and flow rate to an applicator arm 17 extending from the supply chamber 16 to the applicator lip 12, which is positioned opposite the gap 30 as described above with respect to the selective wetting apparatus 2 of FIGS. 1 and 2.

In this example, the applicator arm 17 comprises an upper member 18 and a lower member 19 defining a substantially planar slot flow pathway therebetween for conveying liquid agent 14 from the supply chamber 16 to the lip 12. As shown, in this example, the lower member 19 terminates proximally of the upper member 18 (i.e. closer to the supply chamber 16), such that the upper member 18 projects beyond the lower member 17 towards the roller 20 to terminate at the lip 12. As shown schematically in FIG. 3, the liquid agent is retained on an underside surface of the upper member 18, for example by surface tension forces. By projecting beyond the lower member 19, the lip 12 may reliably define the closest point to the roller surface, so that the behaviour of the liquid agent 14 at the lip 12 and over the gap 30 may be accurately predicted and controlled.

In this example, the applicator unit 10 and roller 20 are coupled to a controller 62. For example, the controller 62 may control rotation of the roller 20 and a rate of supply of liquid agent through the applicator unit 10, as will be described below.

In this example, there are two flow guides 50, each substantially as described above with respect to the wetting apparatus 2 of FIGS. 1 and 2. In this example, the two flow guides 50 form part of a flow unit 40 comprising a flow guide support 42, a blower (or gas mover) 44 and the two flow guides 50.

In this example, the flow guide support 42 is an elongate member extending parallel with the roller axis 24 to support each of the flow guides 50. Each of the flow guides 50 are independently detachably attached to the flow guide support 42. The flow guides 50 may be detachably attached in any suitable way, for example by way of cooperating attachment portions (e.g. a latching or snap-fit arrangement, or a slot), or by a mechanical fastener such as a bolt, screw, rivet or clamp. In this particular example, each of the flow guides 50 are moveable along the flow guide support 42 by virtue of being detachably attachable at a plurality of different positions along the flow guide support 42. The two flow guides 50 are located at different axial positions along the gap 30, as will be described below.

In this example, the flow unit 40 comprises a plurality of blowers 44 corresponding to the plurality of flow guides 50. In other examples, there may be one blower 44 for multiple flow guides 50, or a plurality of blowers 44 each associated with one or more flow guides 50.

In this particular example, each blower 44 has a nozzle to direct a gas flow 56 over a corresponding one of the flow guides 50. In this example, each blower is independently controllable by the controller 60 of the flow unit 40, so that gas flows can be independently selectively caused to flow along each respective flow guide 50 to result in a plurality of different combinations of unwetted and wetted axial portions on the roller surface 22 of the roller, as will be described below.

In this example, the selective wetting apparatus 4 further comprises a doctor blade 38 to meter liquid agent received on the wettable roller surface 22. The doctor blade 38 has a tip which is to engage the roller surface 22 at a position rotationally downstream of the gap 30, such that in use an angular portion of the roller surface 22 rotates first past the gap 30 before second reaching the doctor blade. In the particular example of FIG. 3, the doctor blade 38 has a tip which engages the roller surface 22 below the gap 30. As shown in FIG. 3, the doctor blade 38 has a gap-facing side which is to receive the gas flow 56 passing through the regulated axial portion of the gap 30, and the diverted liquid agent 14. In some examples, the doctor blade 38 may be to direct the diverted liquid agent 14 to a drain or collection arrangement, such as a liquid agent reservoir for resupply to the applicator unit 10'.

Figure 4:
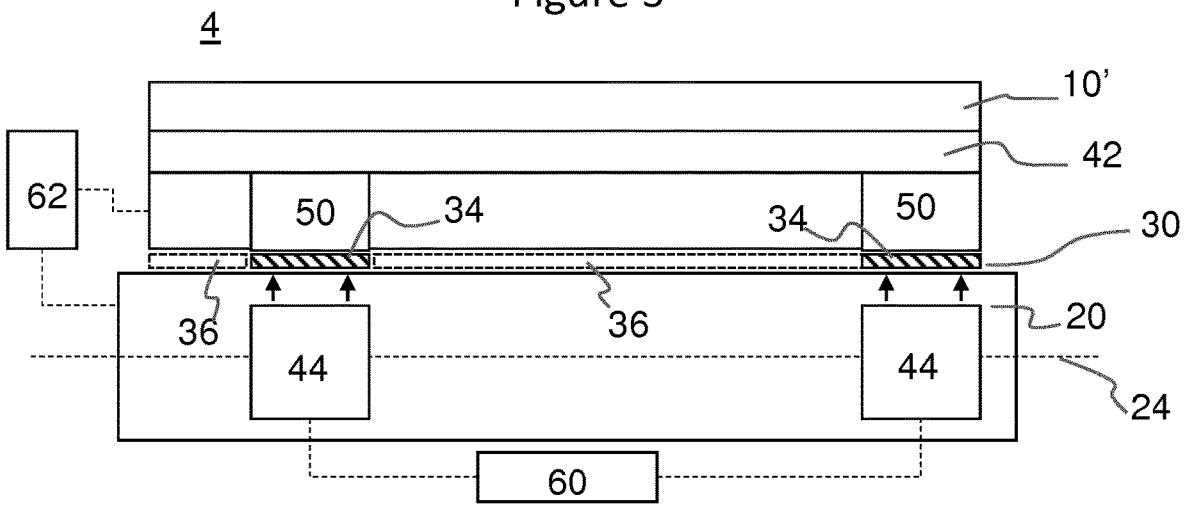
FIG. 4 is simplified schematic plan view of the wetting apparatus of FIG. 4.

FIG. 4 schematically shows the selective wetting apparatus 4 in plan view. As shown, in this example there are two flow guides 50 at different axial positions along the gap 30. In this example, a first one of the flow guides 50 is disposed towards but spaced apart from a first axial end of the gap 30, such that the corresponding regulated axial portion 34 of the gap is spaced apart from the respective (closest) axial end of the gap 30. A second one of the flow guides 50 is disposed adjacent the opposing axial end of the gap 30, such that the respective regulated axial portion 34 of the gap extends to the respective axial end of the gap. Accordingly, in this particular example, the first one of the flow guides 50 is to selectively cause an unwetted lane on the roller surface 22—i.e. an unwetted portion surrounded by wetted portions. In contrast, the second one of the flow guides 50 is to selectively narrow the axial extent of a wetted portion of the roller, by effectively forming a lane at one axial end of the gap 30. In press printing, the pattern of wetted and unwetted portions is transferred to a substrate.

FIG. 4 also shows the blowers 44 provided in opposing relationship to each of the respective flow guides 50 to direct a gas flow 56 onto the respective flow guides 50. As shown, each blower 44 is coupled to a controller 60 for independently selectively activating and stopping the blowers 44, as will be described below.

Figure 5:
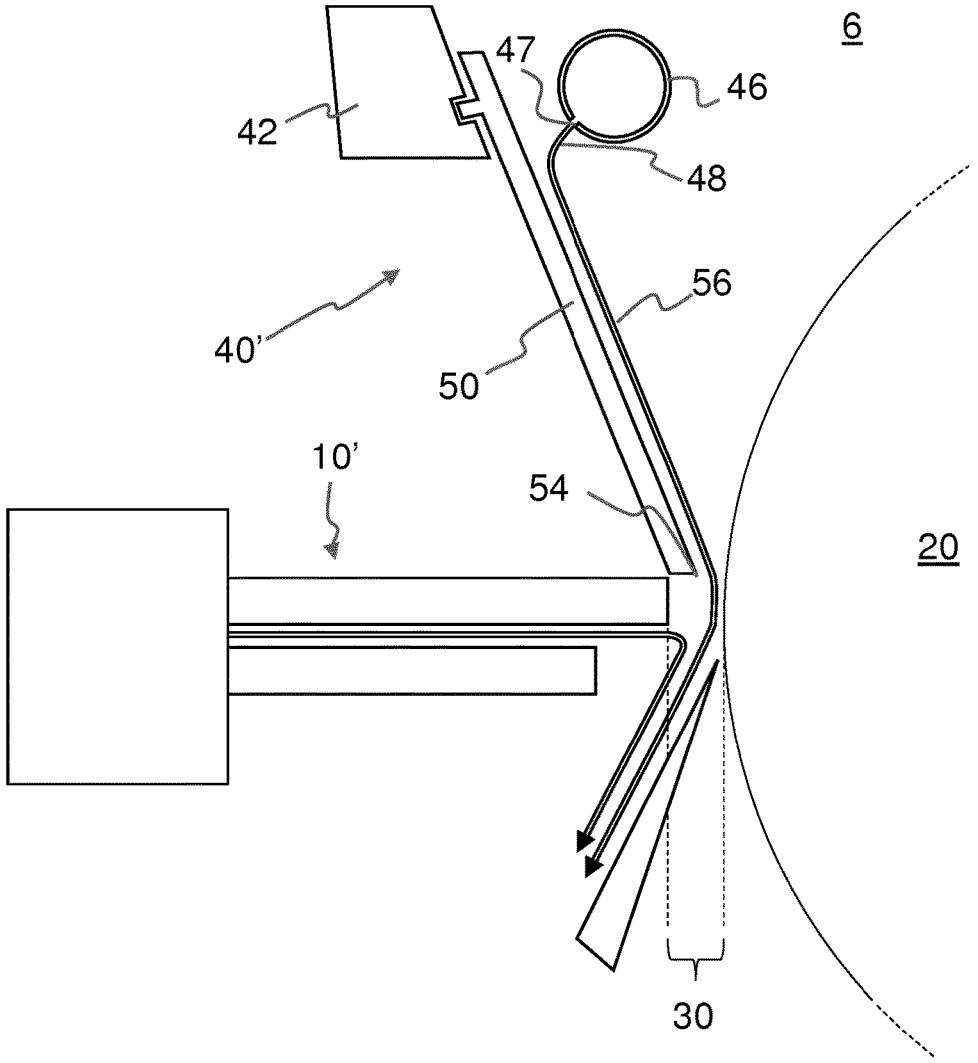
FIG. 5 is a simplified schematic cross-sectional view of an example selective wetting apparatus.

FIG. 5 shows a further example selective wetting apparatus 6 which differs from the selective wetting apparatus 4 described above with respect to FIGS. 3 and 4 in the configuration of the flow unit 40'. In this example, there are two flow guides 50 detachably attached to a flow guide support 42 by way of a slider arrangement. In this particular example, each of the flow guides 50 has a protrusion which cooperates with a corresponding groove in the flow guide support 42 to permit axial sliding of each of the flow guides 50 along the flow guide support to vary their axial position. The flow guides may be clamped in place, for example by a clamp, locking bolt or grub screw. The sliding arrangement may provide a particularly simple and efficient way of adjusting the axial positions of the flow guides 50. Flow guides 50 may be detachable by sliding them out of the groove, which may be open at one or both axial ends of the flow guide support 42.

In this example, the flow unit 40' comprises an elongate blower 46 which is to direct a planar gas jet 48 along a direction perpendicular to the roller axis 24. In this particular example, the elongate blower 46 is elongate along a direction parallel with the roller axis 24, and has an axial extent substantially equal and coextensive with the axial extent of the gap 30. In this example, the elongate blower 46 has an elongate nozzle 47 in the form of an axial slot along its axial extent, so as to direct the planar gas jet from the blower 46. As shown in FIG. 5, in this example the blower 46 is disposed on a side of the flow reception end 52 of each of the flow guides which is closer to the roller 20, and is to direct the planar gas jet 48 along a direction substantially tangential to the closest point on the roller surface 22 towards the respective flow guides. Where the planar gas jet 48 intersects the respective flow guides 50, it is caused to turn to form the gas flow 56 as described above. By providing a blower 46 having an elongate nozzle, flow guides 50 in a plurality of different positions may be used to direct respective gas flows 56 into respective regulated axial portions of the gap 30 using the gas flow source—i.e. the elongate blower 46.

Figure 6:
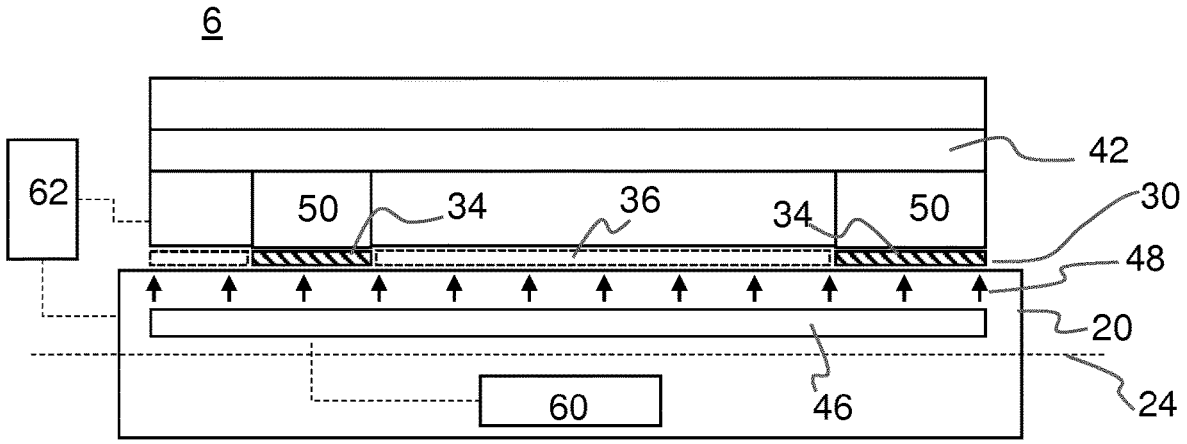
FIG. 6 is simplified schematic plan view of the wetting apparatus of FIG. 5.

FIG. 6 schematically shows the selective wetting apparatus 6 in plan view. As shown, the flow guides 50 are disposed in similar axial positions along the gap 30 as described above with respect to the selective wetting apparatus 4 of FIGS. 3 and 4. However, in this example, the flow guides 50 have differing axial widths. By providing flow guides 50 of differing axial widths, a pattern of wetted and unwetted axial portions on the roller surface 22 (and thereby, any substrate to which the pattern is applied) can be adjusted by interchanging different flow guides 50, adjusting their axial positions, or both. Flow guides 50 may be selected from a set of flow guides of assorted widths.

Figure 7:
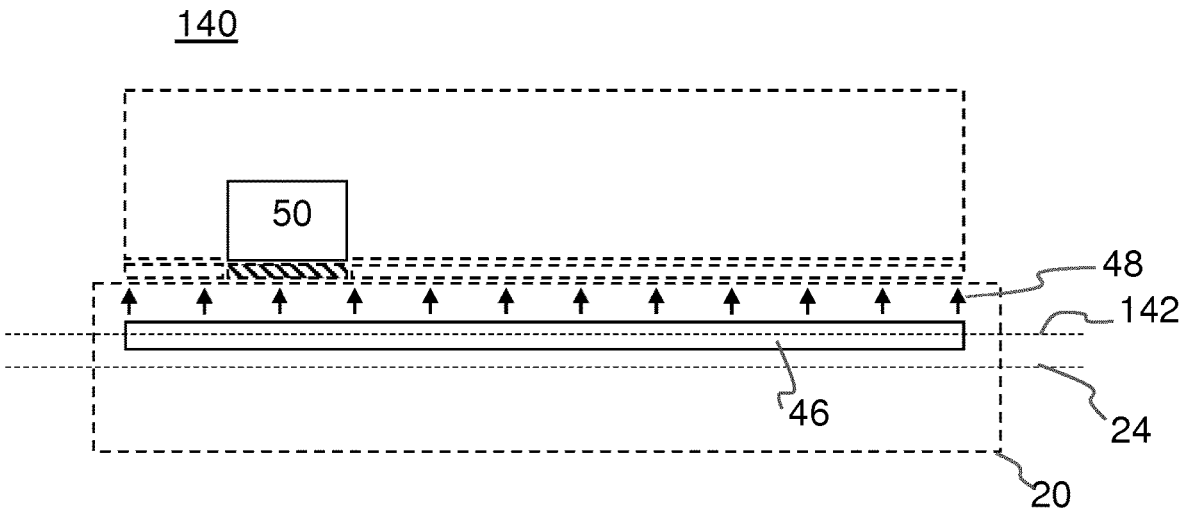
FIG. 7 is a simplified schematic plan view of an example flow unit.

FIGS. 3-6 show flow units 40, 40' as installed in respective selective wetting apparatus 2, 4. Such flow units 40, 40' may be provided separately and retroactively installed in a wetting apparatus to provide a selective wetting apparatus as described above. FIG. 7 shows a flow unit 140 for installation in a wetting apparatus to locally disrupt supply of liquid agent from a lip of an applicator unit over a gap to a wettable roller surface of a roller. Components of the flow unit 140 are shown in solid lines in relation to components of an apparatus in which the flow unit 140 is to be installed, shown in dashed lines respectively. The flow unit 140 comprises a blower 46 comprising an elongate nozzle to direct a planar gas jet 48 along a jet direction normal to a first axis 142. In this example, the nozzle is elongate along the first axis 142.

The flow unit 140 further comprises a flow guide 50 having an axial extent along the first axis 142 which is less than the axial extent of the nozzle along the first axis 142. Accordingly, the flow guide 50 is to direct a sub-portion of the planar gas jet 48 (in use) into a corresponding regulated axial portion of the gap between the wettable surface of the roller and the lip of the applicator unit.

In this example, the flow unit 140 is to be installed in a wetting apparatus so that the first axis 142 is parallel with a roller axis 24 of a roller 20, such that the planar gas jet 48 is directed from the elongate nozzle along a direction normal to the roller axis.

In other examples, the flow unit 140 may comprise an elongate nozzle 47 which is to fit to a blower, or re-direct a gas flow from a blower, which is separate from the flow unit 140, for example a blower provided in the apparatus in which the flow unit 140 is to be installed, or a separate blower.

The flow unit 140 may have any of the features of the example flow units 40, 40' described above with respect to FIGS. 3-6. For example, the flow unit 140 may further comprise a flow guide support, and the flow guide 50 may be moveable along the flow guide support to vary an axial position of the regulated axial portion of the gap in use. Further, there may be a plurality of flow guides 50 axially spaced apart from each other, each having an axial extent along the first axis 142 which is less than the axial extent of the nozzle along the first axis 142. Each flow guide 50 may be to direct a respective axial portion of the gas jet into a respective regulated axial portion of the gap to locally disrupt supply of liquid agent to the roller surface, thereby preventing wetting of a corresponding axial portion of the roller surface.

The example flow units 40, 40', 140 described above with respect to FIGS. 3-7 may be provided as a kit—i.e. a flow unit kit. Examples of such a kit are shown in each of FIGS. 3-7, as installed. The kit may comprise an elongate nozzle to direct a planar gas jet along a direction normal to a first axis, a flow guide support, and a plurality of flow guides each mountable to the flow guide support to direct an axial portion of the gas jet into a corresponding regulated axial portion of a gap to locally disrupt supply of liquid agent to a roller surface, thereby preventing wetting of a corresponding axial portion of the roller surface.

The flow unit kit may comprise at least two flow guides having different axial extents along the first axis when mounted to the flow guide. By providing a kit having flow guides of different axial extents, an operator may assemble a flow unit by selecting one or more of the flow guides to prevent wetting of a portion of the roller surface having a corresponding axial extent. In other words, an operator may select a flow guide having a width corresponding to an intended width of an unwetted portion on a roller.

A flow unit may be assembled from the kit having a plurality of flow guides, as described above. For example, a flow unit kit may comprise ten flow guides of assorted widths, permitting assembly of a flow unit with flow guides in a large number of permutations of flow guide widths and axial positions.

In the examples described above, wetting of the roller is prevented by directing a gas flow into the gap between the applicator unit and the roller. The apparatus for directing the gas flow can be provided separately to the applicator unit and roller equipment, and may be retroactively installed. Accordingly, wetting of a roller can be selectively controlled without modification of the applicator unit and the roller, or introduction of a bespoke auxiliary roller having raised portions or grooves to control selective wetting.

Figure 8:
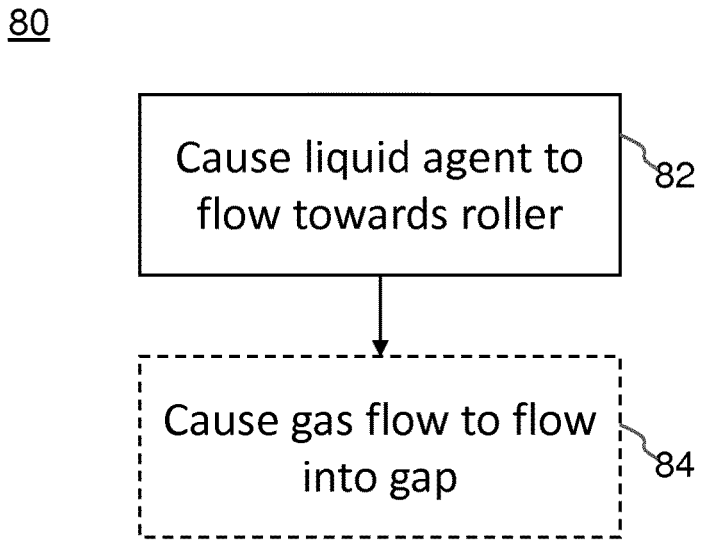
FIG. 8 is a flowchart of an example of a method of operating selective wetting apparatus.

FIG. 8 is a flowchart of an example method 80 of selectively wetting a roller of a selective wetting apparatus, which will be described, by way of example, with respect to the selective wetting apparatus 4 of FIGS. 3-4.

In this example, the method is conducted by a controller 60 of the flow unit and a separate controller 62 coupled to the applicator unit 10 and roller 20. Each controller 60, 62 may comprise a processor and a non-transitory machine readable medium (such as a memory) encoded with instructions executable by the processor to conduct respective parts of the method 80 as described below. In other examples, there may be a controller which is coupled to the applicator unit 10 and roller 20, together with the flow unit 40.

In block 82, the controller 62 controls the applicator unit 10 to cause a liquid agent 14 to be conveyed along the applicator unit 10 to the lip 12 so that the liquid agent forms a liquid bridge over an unregulated axial portion 36 of the gap 30 to wet a corresponding axial portion of the roller surface 22. In this example, the roller 20 is rotating whilst the liquid agent is conveyed to the lip, such that the roller surface 22 is wetted by the liquid agent as the roller 20 rotates.

In block 84, the controller 60 of the flow unit 40 controls a blower 44 of the flow unit 40 to direct a gas flow 56 along a respective flow guide 50 into a regulated axial portion 34 of the gap 30 to locally prevent formation of a liquid bridge, thereby preventing wetting of a corresponding axial portion of the roller surface 22, which may be referred to as an unwetted portion.

In some examples, the blower may be inactive for a period before it is controlled to cause the gas flow 56 to flow into the regulated axial portion 34 of the gap. Accordingly, when the blower is inactive a liquid bridge may form over the respective regulated axial portion 34. In the example selective wetting apparatus 4 there are two blowers 44 associated with respective flow guides 50. Either one may be controlled to direct the gas flow 56 as described above with respect to block 84, or each blower 44 may be controlled together. When each of the blowers are inactive, an axial extent of the roller surface 22 corresponding to the axial extent of the gap 30 may be wetted.

FIG. 8 shows blocks executed by the controller 62 coupled to the applicator unit 10 in solid lines, and blocks executed by the controller 60 of the flow unit 40 in dashed lines. Each block may be instructed independently by respective instructions encoded on respective non-transitory machine readable media.

Figure 9:
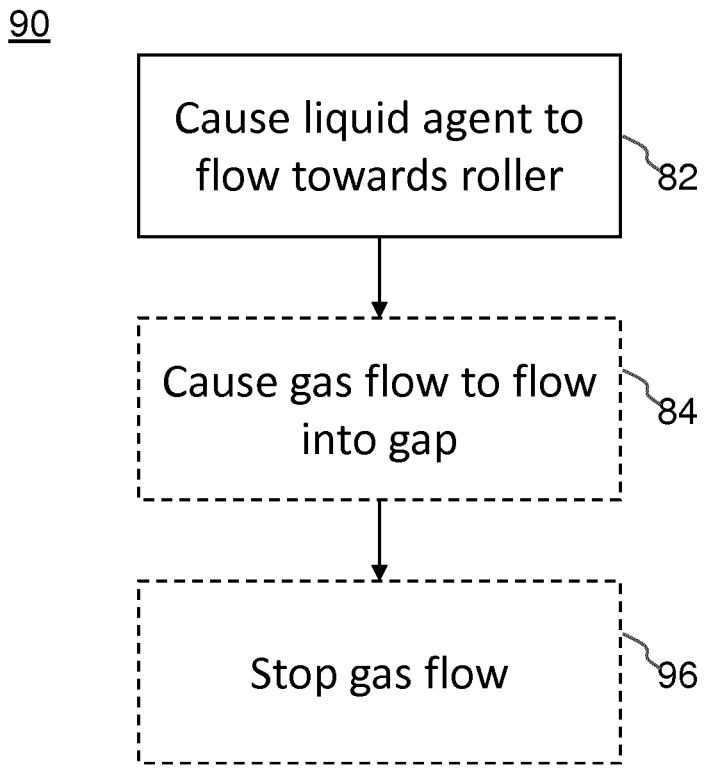
FIG. 9 is a flowchart of a further example of a method of operating selective wetting apparatus.

FIG. 9 is a flowchart of a further example method 90 of selectively wetting a roller of a selective wetting apparatus, which will be described, by way of example, with respect to the selective wetting apparatus 4 of FIGS. 3-4.

FIG. 9 includes blocks 82, 84 of causing liquid agent to flow towards the roller and causing gas to flow into the air gap as described above with respect to FIG. 8.

In block 96, the controller 60 of the flow unit 40 controls the blower to stop directing the gas flow 56 along the flow guide 50 into the respective regulated axial portion 34 of the gap whilst the roller 20 is rotating. Accordingly, formation of a liquid bridge at the regulated axial portion 34 is no longer prevented, and an axial portion of the roller surface 22 corresponding to the regulated axial portion 34, where wetting was prevented whilst the blower 44 was directing the gas flow 56, becomes wetted. It will be appreciated that this may be an angularly-separated portion of the roller surface 22. By activating and deactivating the blower, the formation of a lane on the roller surface 22 where wetting is prevented may be selectively controlled.

Figure 10:
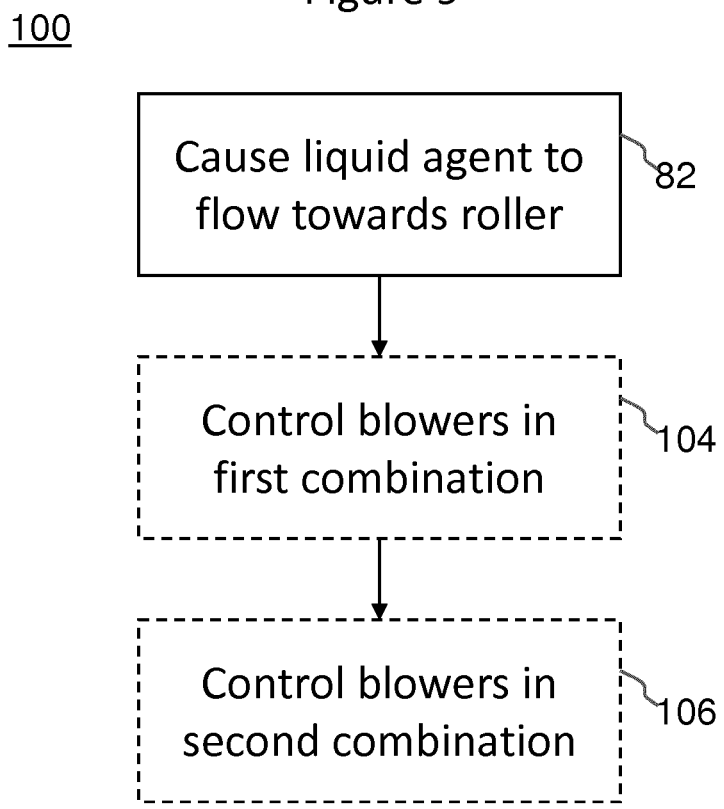
FIG. 10 is a flowchart of a further example of a method operating selective wetting apparatus.

FIG. 10 is a flowchart of a method 100 of selective wetting a roller of a selective wetting apparatus, which will be described, by way of example, with respect to the selective wetting apparatus 4 of FIGS. 3-4.

FIG. 10 includes block 82 of causing liquid agent to flow towards the roller as described above with respect to the methods 80, 90 of FIGS. 8, 9.

In block 104, the controller 60 of the flow unit 40 controls the blowers 44 to operate in a first combination in which a first blower 44 directs a respective gas flow 56 into a respective first regulated axial portion 34 of the gap 30, and a second blower 44 is stopped so that it does not direct a respective gas flow into a respective second regulated axial portion 34 of the gap 30. For example, the first blower 44 may be disposed towards one axial end of the gap 30, and the second blower 44 may be disposed towards an opposing axial end of the gap 30.

In block 106, the controller 60 of the flow unit 40 controls the blowers to operate in a second combination in which the second blower 44 directs a respective second gas flow 56 into the respective second regulated axial portion 34 of the gap. Accordingly, the second combination results in a different pattern of wetted and unwetted axial portions on the roller surface 20, since the second blower 44 is activated in the second combination but not in the first. In this particular example, the first blower is stopped in block 106, but in other examples the first blower may be active (i.e. it may direct the respective gas flow along the flow guide 50 and into the respective first regulated axial portion 34).

By controlling the blowers in at least first and second combinations such as those described above, wetted and unwetted portions of the roller surface may be varied in use.

By way of example, such combinations may be interchanged during press printing to selectively control the formation of lanes on a substrate (i.e. axial portions of the substrate where a liquid agent is selectively omitted in printing), or to control narrowing of an axial extent of a liquid agent by preventing wetting at an axial edge of the gap.

In each of the example methods 80, 90, 100 described above, the method is conducted by a controller 60 of the flow unit and a separate controller 62 coupled to the applicator unit 10 and roller 20. Each controller 60, 62 may comprise a processor and a non-transitory machine readable medium (such as a memory) encoded with instructions executable by the processor to conduct respective parts of the method 80 as described below. In other examples, there may be a controller which is coupled to the applicator unit 10 and roller 20, together with the flow unit 40.

Figure 11:
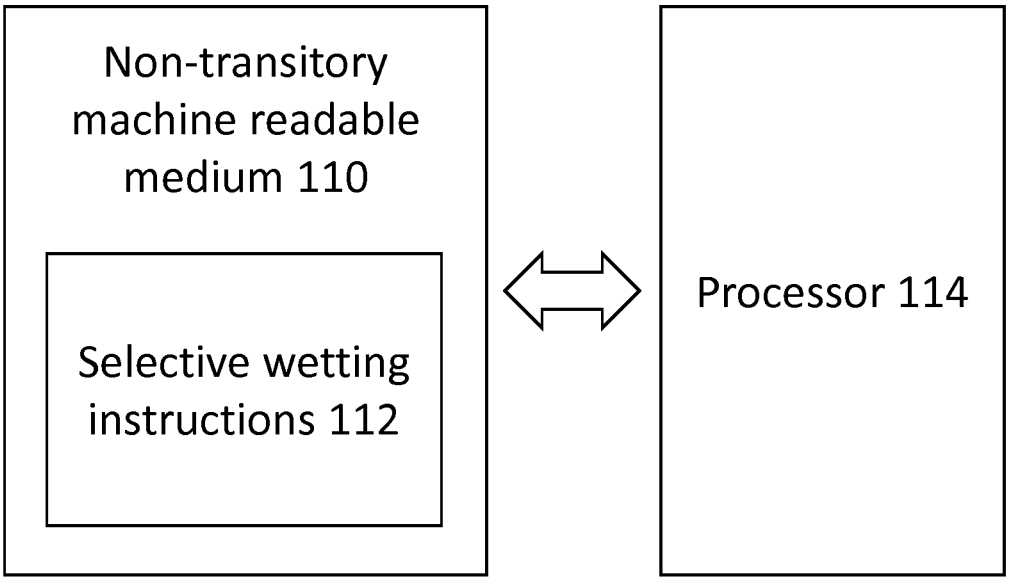
FIG. 11 is a simplified schematic of an example machine readable medium and a processor including instructions for operating wetting apparatus for selective wetting.

Examples in the present disclosure can be provided as methods, systems or machine readable instructions, such as any combination of software, hardware, firmware or the like. Such machine readable instructions may be included on a machine (or computer) readable storage medium (including but is not limited to disc storage, CD-ROM, optical storage, etc.) having computer readable program codes therein or thereon. FIG. 11 schematically shows a non-transitory machine readable medium 110 comprising instructions 112 and a processor 114. The instructions 112 may be to cause, when executed by the processor 114, execution of one or more blocks of the methods 80, 90, 100 as described above with respect to FIGS. 8, 9, 10, for example blocks described above as controlled by the controller 60 of the flow unit 40, or by the controller 62 coupled to the applicator unit 10 and the roller 20.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A selective wetting apparatus comprising:

a roller rotatable about a roller axis and comprising a wettable roller surface;

an applicator unit having a lip which extends parallel to the roller axis and is radially spaced apart from the roller surface by a gap, wherein the applicator unit is to convey liquid agent towards the roller so that the liquid agent forms a liquid bridge over the gap to wet the wettable roller surface; and a flow guide in fluid communication with a gas flow source, wherein the flow guide that includes an elongate member extending from a gas flow reception portion away from the gap to a flow guide edge adjacent the gap to direct a gas flow from the gas flow reception portion along the flow guide to be discharged at the flow guide edge into a regulated axial portion of the gap to divert a path of the liquid agent away from the roller surface to locally prevent formation of the liquid bridge, and thereby prevent wetting of a corresponding axial portion of the roller surface.

2. The selective wetting apparatus according to claim 1, wherein the flow guide terminates at the flow guide edge adjacent the gap.

3. The selective wetting apparatus according to claim 1, wherein the flow guide comprises an open guide surface to direct the gas flow to the gap.

4. The selective wetting apparatus according to claim 1, wherein the flow guide is moveable along a flow guide support to vary an axial position of the regulated axial portion of the gap.

5. The selective wetting apparatus according to claim 1, comprising a plurality of flow guides to direct respective gas flows into respective regulated axial portions of the gap to locally prevent formation of a liquid bridge, and thereby prevent wetting of corresponding axial portions of the roller surface.

6. The selective wetting apparatus according to claim 5, comprising the gas flow source, wherein the gas flow source comprises a plurality of blowers each associated with a respective flow guide, and a controller to selectively control each blower to generate a gas flow onto the respective flow guide.

7. The selective wetting apparatus according to claim 1, comprising the gas flow source, wherein the gas flow source comprises an elongate nozzle to direct a planar gas jet along a jet direction normal to the roller axis;

wherein the flow guide has an axial extent parallel to the roller axis which is less than the axial extent of the nozzle parallel to the roller axis; and wherein the flow guide is to direct a portion of the planar jet into the regulated axial portion of the gap.

8. The selective wetting apparatus according to claim 1, further comprising a doctor blade to meter liquid agent on the roller surface;

wherein the doctor blade is on an opposite side of the gap from the flow guide; and wherein the doctor blade is to receive a flow of disrupted liquid agent from the regulated axial portion of the gap.

9. The selective wetting apparatus according to claim 1, further comprising:

a flow guide support comprising an elongate member extending parallel with the roller axis to support the flow guide, the flow guide being moveable along the flow guide support to vary an axial position of the regulated axial portion of the gap; and the gas flow source, wherein the gas flow source comprises a blower associated with the flow guide to selectively control and to generate gas flow onto the flow guide.

10. The selective wetting apparatus according to claim 1, wherein the presence of the liquid bridge over the gap in the axial portion is configured to be regulated by the presence or absence of the gas flow being directed along the flow guide into the gap.

11. The selective wetting apparatus according to claim 1, wherein the gas flow is configured to be directed into the gap along a direction having a downward component.

12. The selective wetting apparatus according to claim 1, wherein the gas flow is directed along a direction which is configured to be inclined with respect to a local tangent of the roller surface at the gap.

13. The selective wetting apparatus according to claim 1, wherein the flow guide is an open guide surface such that the gas flow along the flow guide is unbounded except by a guide surface of the flow guide.

14. The selective wetting apparatus according to claim 13, wherein the guide surface of the flow guide is not opposed by an opposing guide surface which bounds the gas flow.

15. A selective wetting apparatus comprising:

a roller rotatable about a roller axis and comprising a wettable roller surface;

an applicator unit having a lip which extends parallel to the roller axis and is radially spaced apart from the roller surface by a gap, wherein the applicator unit is to convey liquid agent towards the roller so that the liquid agent forms a liquid bridge over the gap to wet the wettable roller surface;

a gas flow source comprising a plurality of blowers;

a plurality of flow guides in fluid communication with the gas flow source, wherein the flow guide includes an elongate member extending from a gas flow reception portion away from the gap to a flow guide edge adjacent the gap to direct a gas flow from the gas flow reception portion along the flow guide to be discharged at the flow guide edge into a regulated axial portion of the gap to divert a path of the liquid agent away from the roller surface to locally prevent formation of the liquid bridge, and thereby prevent wetting of a corresponding axial portion of the roller surface, wherein individual blowers of the plurality of blowers are individually associated with a respective flow guide of the plurality of flow guides; and a controller to selectively control the individual blowers of the plurality of blowers to generate a gas flow onto the respective flow guide of the plurality of flow guides.

16. The selective wetting apparatus according to claim 15, wherein the flow guide comprises an open guide surface to direct the gas flow to the gap.

17. The selective wetting apparatus according to claim 15, wherein the flow guide is moveable along a flow guide support to vary an axial position of the regulated axial portion of the gap.

18. A selective wetting apparatus comprising:

a roller rotatable about a roller axis and comprising a wettable roller surface;

an applicator unit having a lip which extends parallel to the roller axis and is radially spaced apart from the roller surface by a gap, wherein the applicator unit is to convey liquid agent towards the roller so that the liquid agent forms a liquid bridge over the gap to wet the wettable roller surface;

a gas flow source comprising an elongate nozzle to direct a planar gas jet along a jet direction normal to the roller axis; and a flow guide in fluid communication with the gas flow source, wherein the flow guide includes an elongate member extending from a gas flow reception portion away from the gap to a flow guide edge adjacent the gap to direct a gas flow from the gas flow reception portion along the flow guide to be discharged at the flow guide edge into a regulated axial portion of the gap to divert a path of the liquid agent away from the roller surface to locally prevent formation of the liquid bridge, and thereby prevent wetting of a corresponding axial portion of the roller surface, and wherein the flow guide is to direct a portion of the planar jet into the regulated axial portion of the gap.

19. The selective wetting apparatus according to claim 18, wherein the flow guide comprises an open guide surface to direct the gas flow to the gap.

20. The selective wetting apparatus according to claim 18, wherein the flow guide is moveable along a flow guide support to vary an axial position of the regulated axial portion of the gap.

* * * * *